United States Patent [19]

Decker

[11] Patent Number: 4,494,342

[45] Date of Patent: Jan. 22, 1985

[54] INSULATED GLASS ADAPTIVE METHOD AND APPARATUS

[76] Inventor: G. Warren Decker, 131 Lenwood Dr., Sparks, Nev. 89431

[21] Appl. No.: 451,980

[22] Filed: Dec. 21, 1982

[51] Int. Cl.[3] ..... E06B 3/64; E06B 3/28

[52] U.S. Cl. ..... 52/203; 52/746

[58] Field of Search ..... 52/202, 203, 746, 741

[56] References Cited

U.S. PATENT DOCUMENTS

| | | | |
|---|---|---|---|
| 2,436,037 | 2/1948 | Doney | 52/203 |
| 3,824,753 | 7/1974 | Anderson | 52/203 |
| 3,881,290 | 5/1975 | Bouchey | 52/746 X |
| 3,971,178 | 7/1976 | Mazzoni et al. | 52/203 X |
| 4,041,663 | 8/1977 | Mazzoni | 52/746 X |
| 4,194,331 | 3/1980 | Gingle | 52/203 |
| 4,208,849 | 6/1980 | Lamb | 52/203 |
| 4,357,187 | 11/1982 | Stanley et al. | 52/203 X |

FOREIGN PATENT DOCUMENTS

| | | | |
|---|---|---|---|
| 2824896 | 12/1979 | Fed. Rep. of Germany | 52/203 |
| 2304758 | 10/1976 | France | 52/203 |
| 2027101 | 2/1980 | United Kingdom | 52/203 |
| 2044334 | 10/1980 | United Kingdom | 52/203 |

*Primary Examiner*—J. Karl Bell

*Attorney, Agent, or Firm*—Herbert C. Schulze

[57] ABSTRACT

This invention is a method, and apparatus for performing the method, wherein ordinary single-pane windows, door, and the like, can be converted to double-pane or triple-pane insulated items. The method involves trimming of caulking material, disassembling the frame of the item, partially or fully, and placing suitable spacing material around the existing pane of glass, and placing another pane of glass adjacent the spacing material, inserting a pre-formed holding member into the frame encompassing the new pane, and reassembling the frame. The same procedure is followed for triple-pane, except that additional spacing material and glass are added.

5 Claims, 28 Drawing Figures

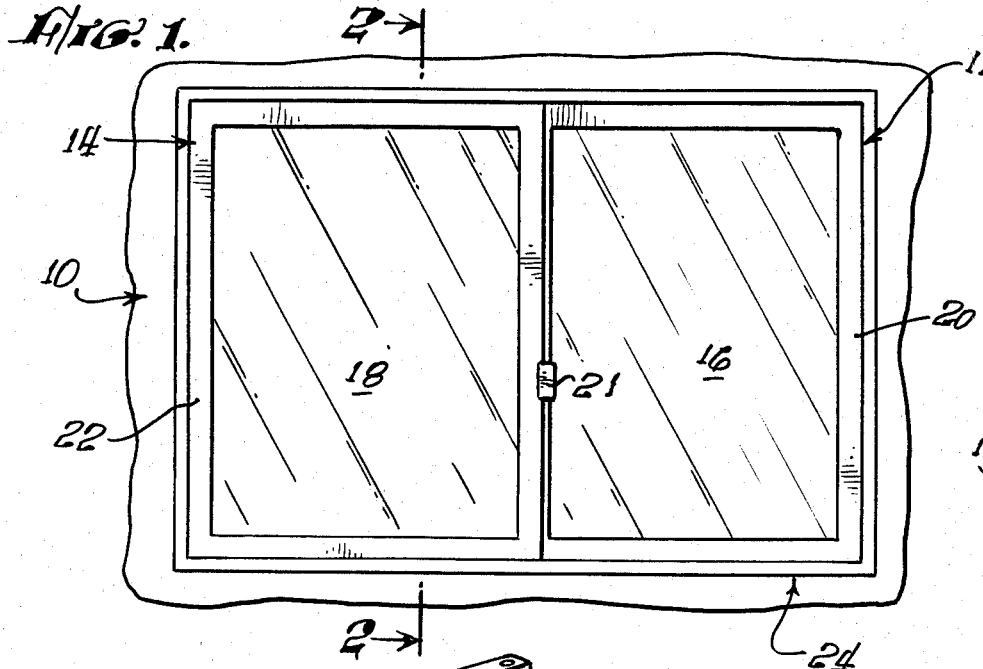
FIG. 1.
2
12
14
10
18
16
21
20
22
24
2
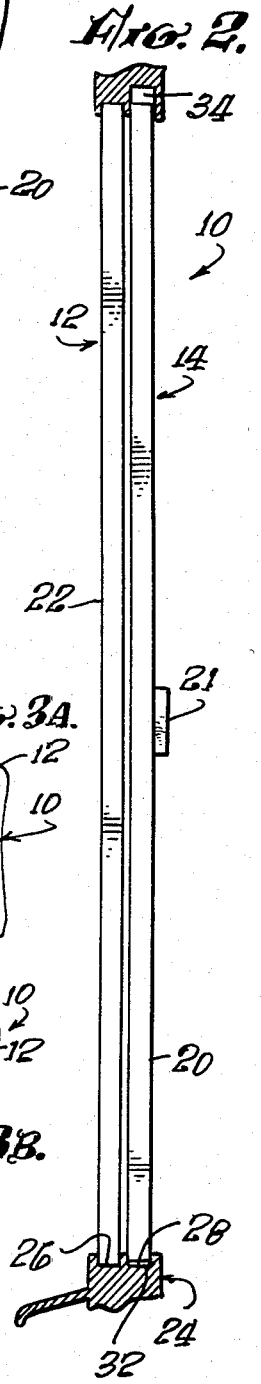
FIG. 2.
34
10
12
14
22
21
20
26
28
24
32
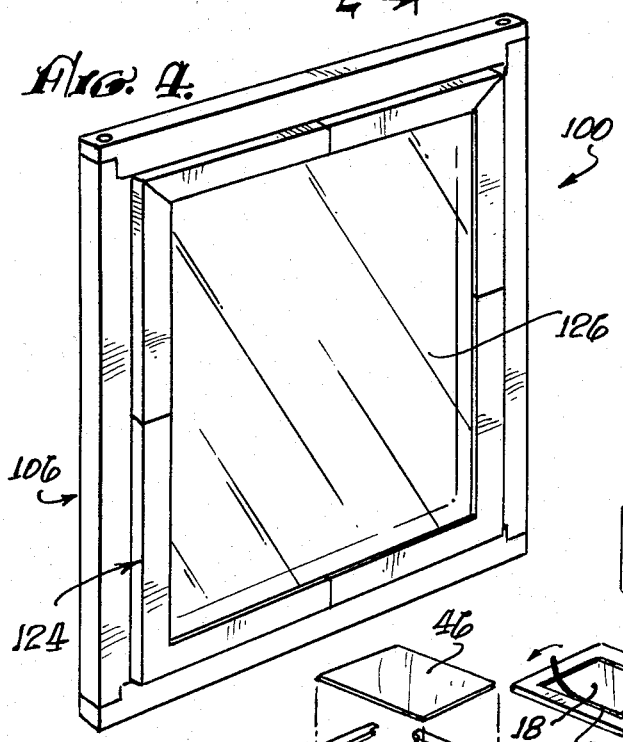
FIG. 4.
100
126
106
124
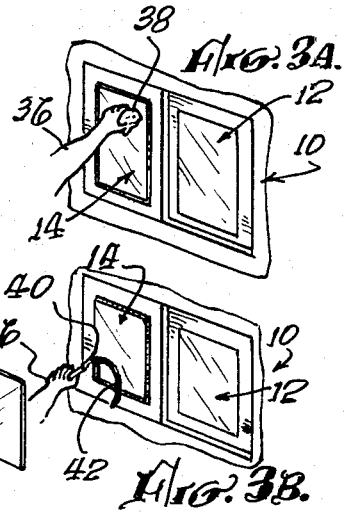
38
FIG. 3A.
36
12
10
14
14
40
36
10
12
42
FIG. 3B.
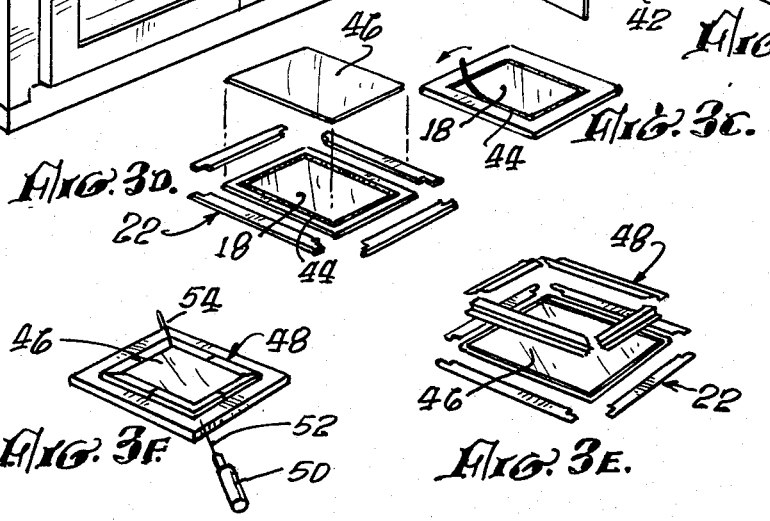
46
18
44
FIG. 3C.
FIG. 3D.
22
18
44
54
46
48
52
50
FIG. 3F.
48
46
22
FIG. 3E.

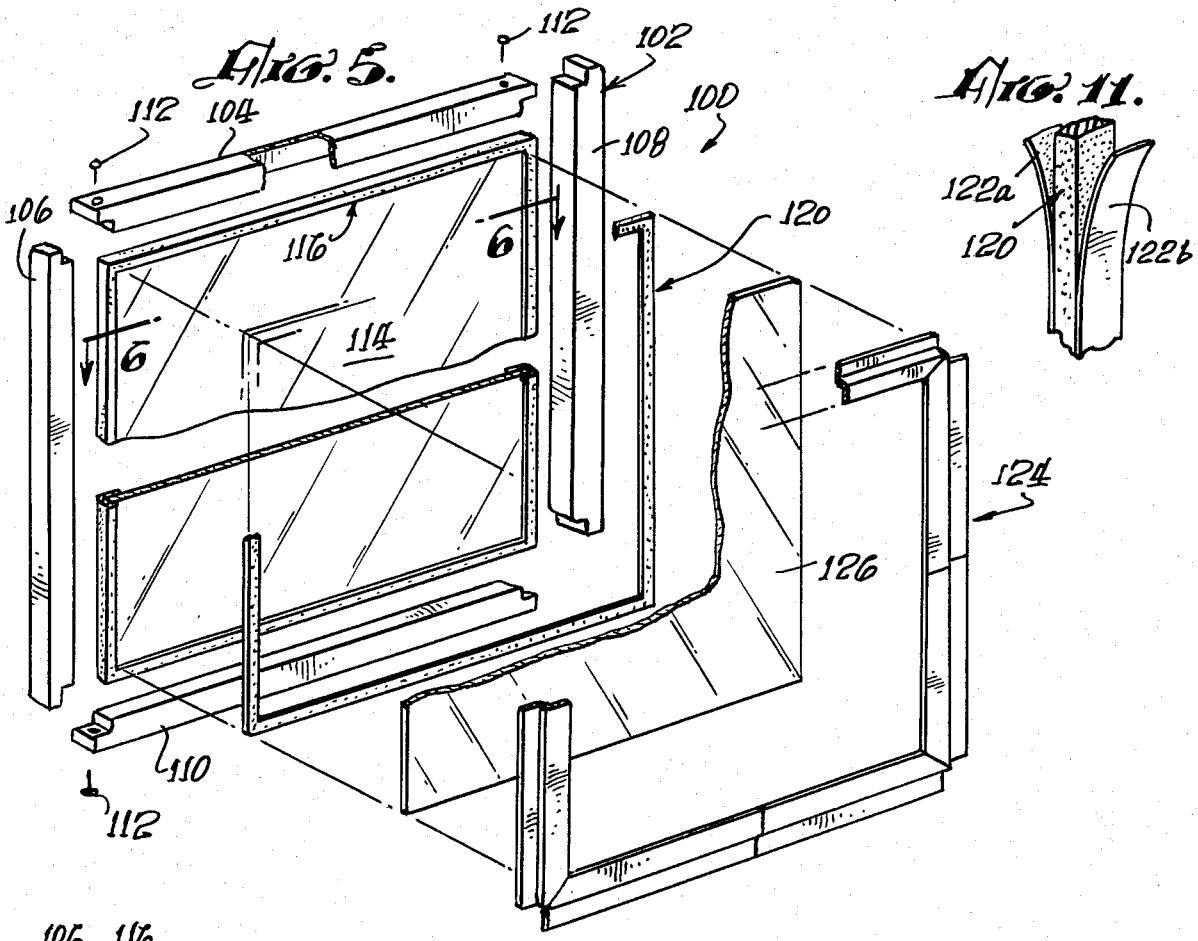
FIG. 5.
112
102
100
104
108
106
116
6
120
114
124
126
110
FIG. 11.
122a
120
122b
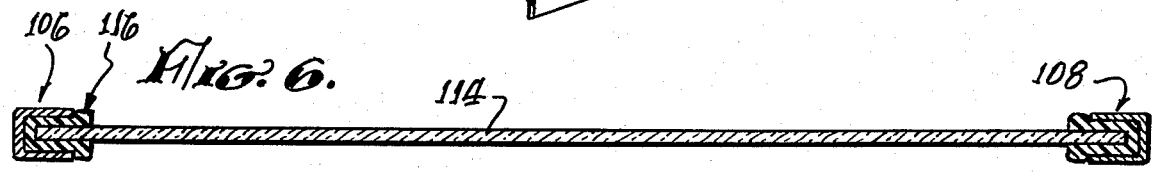
106
116
FIG. 6.
114
108
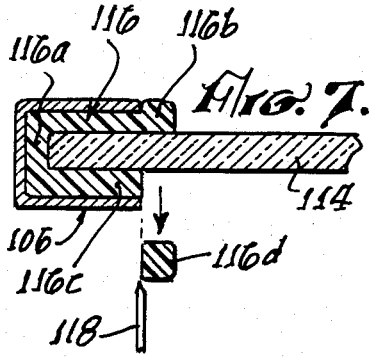
116a
116
116b
FIG. 7.
114
106
116c
116d
118
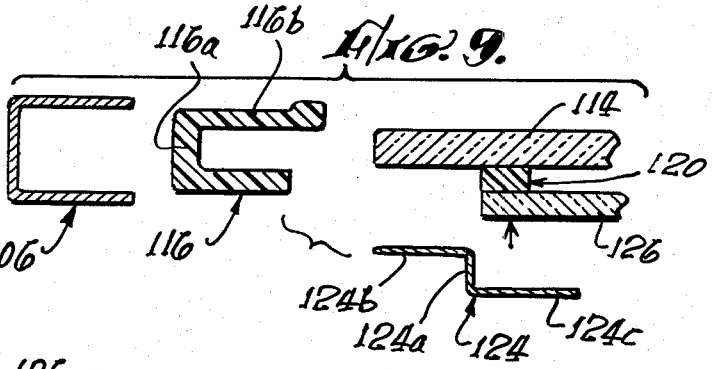
116a
116b
FIG. 9.
114
120
106
116
126
124b
124a
124
124c
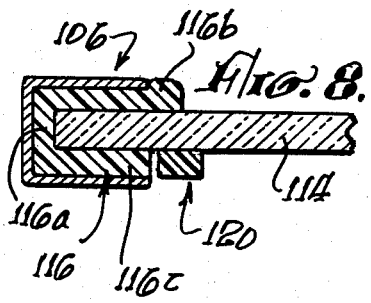
106
116b
FIG. 8.
114
116a
120
116
116c
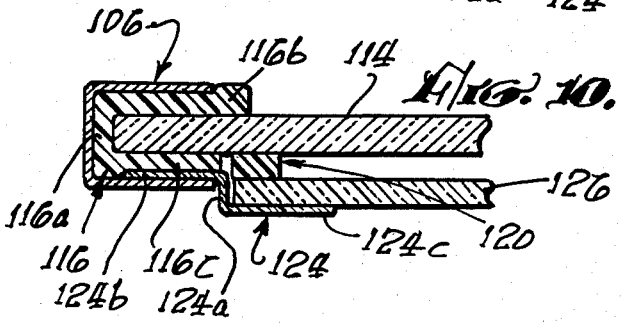
106
116b
114
FIG. 10.
126
116a
116
116c
124
124c
120
124b
124a FIG. 12.
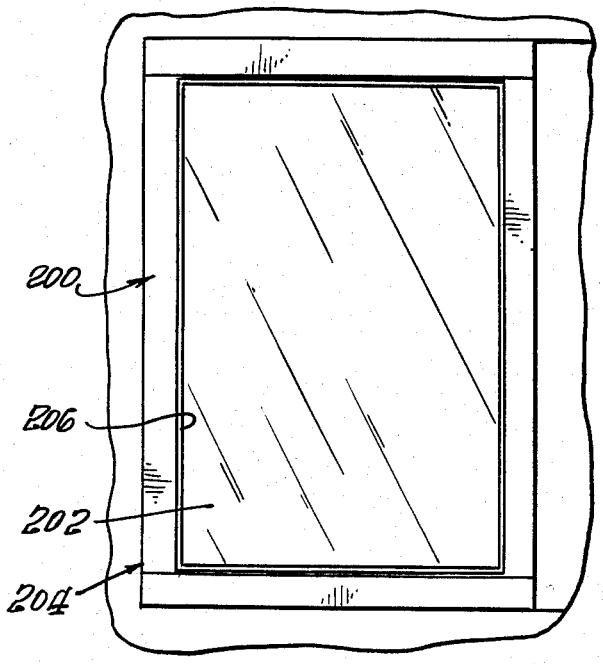
FIG. 13.
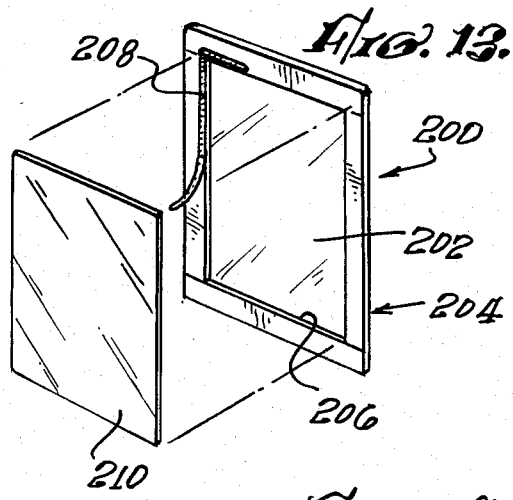
FIG. 14.
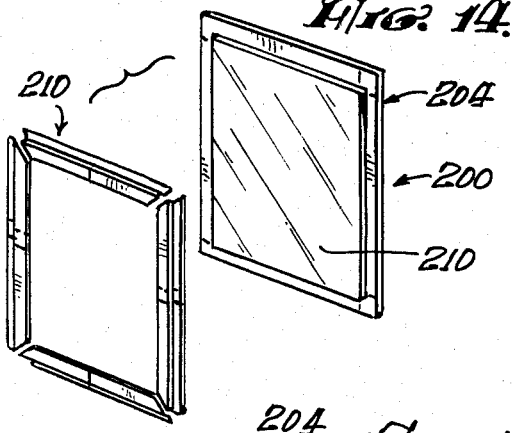
FIG. 15.
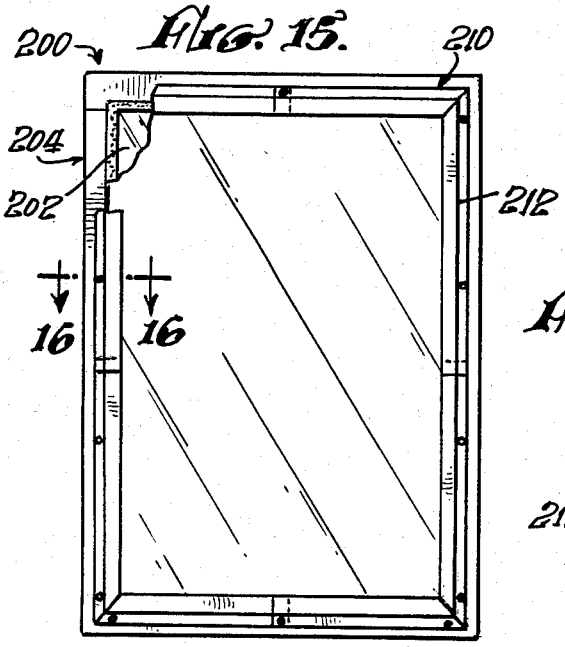
FIG. 16.
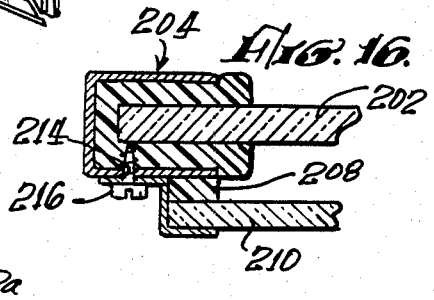
FIG. 18.
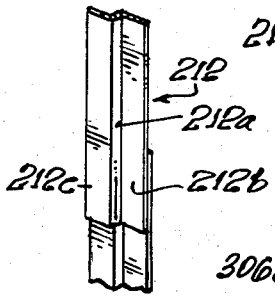
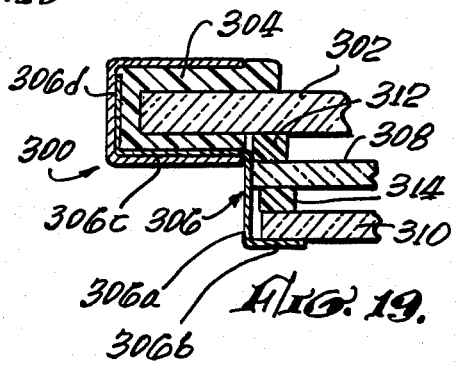
FIG. 19.
FIG. 17.
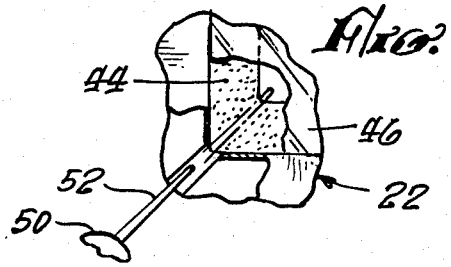

INSULATED GLASS ADAPTIVE METHOD AND APPARATUS

CROSS REFERENCE OF RELATED PATENT APPLICATIONS

There are no patent applications filed by me related to this patent application.

BACKGROUND OF THE INVENTION

1. Field of the Invention:

This invention is in the general field of insulated windows, and is more particularly directed to a method and apparatus by which existing single-pane windows, doors, and the like, can be converted to double or triple pane elements without the necessity of destroying existing glass. The invention is more particularly directed to a method and apparatus for such conversions wherein the existing frame and existing pane of glass become the foundation for the insulated completed adaptive unit.

2. Description of the Prior Art:

There are numerous insulated windows in existence. There are even many methods of converting existing windows, and the like, having single panes of glass to those having multiple panes of glass. For example, there are means provided to adapt a preformed double-pane of glass to an existing single-pane window by destroying the pane already existing and replacing it with an adaptive element. There are means to apply storm windows of various types.

No prior art exists, however, where the existing frame and existing pane are used in the manner which is hereinafter described to form a double or triple-insulated window by the mere addition of one or two panes of glass and encompassing spacing material around the edge with a holding member cooperative within the existing frame. In this respect this invention is unique.

SUMMARY OF THE INVENTION

With the increasing attention being paid to energy conservation and in particular with great emphasis being placed upon heat loss areas in homes, and the like, tremendous attention has been given for several years to insulated windows.

Windows and doors, and the like, having one pane of glass are the cause of a great deal of heat loss from the interior to the exterior of a building during cold periods and from the exterior to the interior of the building during warm periods.

Many existing homes were built with single panes of glass before insulated, double-pane windows, and the like, were available. It is quite costly to remove windows and replace them with double panes of glass.

Some efforts have been made to provide the means for converting existing windows, and the like, to double or triple-pane insulated windows and doors. Such efforts involve either destruction of the entire window or door frame and replacement with a new frame, or rather costly adaptive elements wherein the existing pane is destroyed and an adaptive element is inserted therein with two new pieces of glass in the form of a thermally insulated panel inserted in place of the single pane.

It is also common to provide storm windows or other means of this nature to provide extra insulation around windows and doors.

All of the methods used so far have been expensive and/or cumbersome. I have studied the problem and all of the various methods used for a considerable period of time and have now conceived and perfected a method, and apparatus for performing the method, by which anyone can quickly and economically convert existing single-pane windows and doors to double-panel or even triple-pane elements.

The method I employ in accomplishing this is to trim caulking material about the frame, loosen the existing window frame sufficiently to allow a thin holding element to slip within the frame, place a spacing material (preferably insulating, adhesive material) around the edge of the existing pane, adjacent to the area in which I can place the holding element.

I then provide a pane of glass of the right size to fit upon the spacing material around the existing glass and thereafter assemble with the holding element holding the second (or second and third) pane of glass in place. By saving the existing pane of glass and by not destroying the frame, the entire operation can be accomplished much more economically than any other method presently known for making such conversions.

If required, I also inject nitrogen gas, or the like, or a dessicant into the space between the panes of glass or evacuate air in order to eliminate accumulation of moisture in that area.

It is an object of this invention to provide an economical method of converting a single-pane glass area in buildings into double or triple-pane insulated elements.

Another object of this invention is to provide such a method, and apparatus for performing the method, wherein any reasonably intelligent homeowner can personally convert his windows and doors.

Another object of this invention is to provide such a method and apparatus as has been mentioned wherein the original existing plane of glass and window frame are not damaged.

The foregoing and other objects of this invention will become apparent to those skilled in the art upon reading a description of a preferred embodiment which follows, in conjunction with the appended drawings.

BRIEF DESCRIPTION OF THE DRAWINGS

FIG. 1 is a side elevation, on a reduced scale, of a typical window installation onto which the present method and invention will be administered;

FIG. 2 is an enlarged section taken on line 2—2 of FIG. 1 showing certain parts in elevation;

FIGS. 3A through 3F are simplified perspective views on a reduced scale showing the method of attaching the invention to a conventional sliding window;

FIG. 4 is a perspective of the completed sliding window of FIG. 1 with the invention installed thereto;

FIG. 5 is an exploded perspective of the window of FIG. 4 showing the components involved;

FIG. 6 is an enlarged section taken along line 6—6 of FIG. 5 showing the sliding window prior to modification;

FIG. 7 is a further enlarged fragmentary section of one end of the window of FIG. 6 showing a first step in the modification procedure;

FIG. 8 is a view similar to FIG. 7 showing the installation of an insulating strip;

FIG. 9 is a separated fragmentary section showing further steps of the modification procedure;

FIG. 10 is a view similar to FIGS. 7 and 8 showing the completed window modification;

FIG. 11 is a fragmentary perspective of the insulating strip prior to installation;

FIG. 12 is a side elevation of the fixed window of FIG. 1 as viewed from the opposite side;

FIG. 13 is an exploded perspective on a reduced scale showing beginning procedures of adapting the invention onto the window of FIG. 12;

FIG. 14 is a view similar to FIG. 13 showing a further step in the modification procedure;

FIG. 15 is a side elevation, partly broken away, of a completed fixed window utilizing the modification of the present invention;

FIG. 16 is an enlarged fragmentary section as viewed along line 16—16 of FIG. 15 showing the completed modified window construction;

FIG. 17 is a fragmentary elevation of a segment of the windows of FIGS. 4 and 15 showing the method of injecting a nozzle for purposes of placing an inert gas, or the like, into the zone between a pair of window panes;

FIG. 18 is a fragmentary perspective of the retaining strip shown in FIG. 15;

FIG. 19 is an enlarged section similar to FIGS. 10 16 showing a triple pane window utilizing the procedures and apparatus of the present invention;

DESCRIPTION OF A PREFERRED EMBODIMENT

Figure 20:
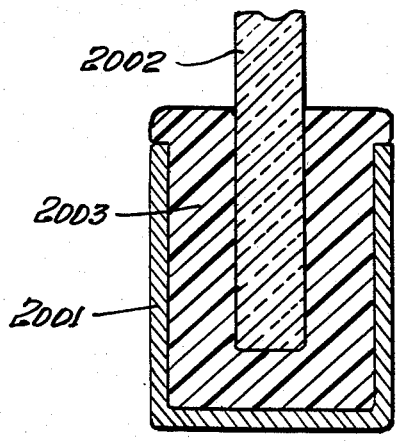
FIG. 20 is an enlarged partial section showing a single-pane glass in a frame.

The window assembly shown in FIG. 1, generally designated by the reference numeral 10, includes a stationary window 12 and a sliding window 14. The single panes of glass 16 and 18, respectively, are shown mounted in frames 20 and 22.

The window opening is shown in FIG. 2 as having a window opening frame 24 with channels 26 and 28. Handle and lock assembly at 30 is indicated and can be of conventional construction and familiar to those versed in such art. The movable window is of a type having runners or rollers at the bottom as shown at 32 and the space at 34 to allow the window to be lifted upwardly and then removed from the confining channel.

FIG. 3A shows a person's hand 36 cleaning the window with a cleaning member 38 to prepare the window for adaptation to receiving the insulating window as will be shown further in this application.

FIG. 3B shows the hand 36 trimming off the exposed caulking using a razor blade or trimming tool 40 to cause the strip to be removed at 42.

FIG. 3C shows a spacing strip being applied to the existing single pane of glass just inside the frame, at the general area from which caulking was previously removed. The spacing material will be later described more fully, but is shown at 44 in a simplified illustration to more clearly and simply describe the transition procedures.

FIG. 3D shows an exploded perspective of the window glass 18 with the spacer 44 in place and the portions of frame 22 disassembled. An additional pane of glass 46 is cut to the proper size and is shown ready to be placed onto the strip 44.

FIG. 3E illustrates a retaining strip assembly 48 which is then placed about the new pane 46 and prior to the segments of the frame 22 being reinstalled into their initial position.

FIG. 3F illustrates the completed conversion and how a supply of inert gas, such as nitrogen, is being inserted by penetrating tip 52 through the seal 44 into the space between the two panes of glass. A bleeding insert 54 allows the air that is being replaced to exit. When the tip 52 and the insert 54 are removed, the window becomes sealed from any outside air or moisture. Thus, condensation of moisture between the glass panes is eliminated.

To more fully describe the components involved in the procedure, I have shown in the exploded perspective of FIG. 5 a complete assembly at 100. The completed unit is shown in FIG. 4. Sliding window frame 102, with edge portions 104, 106, 108 and 110 are of a conventional construction and can be separated easily by the removal of fasteners 112.

The pane of glass 114 is shown as being surrounded by vinyl caulking 116 having a back portion 116*a* and side extensions 116*b* and 116*c*.

FIG. 7 illustrates an early step in the procedure of adapting the single pane window to a multiple pane window. A sharp edged tool 118 is shown trimming a portion of lip 116*c* of caulking 116 and removing portion 116*d*. This leaves an area, zone, proximate the edge of the frame 106 at its inner side free from any of the caulking seal 116, or the like. Many times this caulking may be of a plastic material, such as vinyl, felt, rubber, or other suitable materials for use with glass.

FIG. 8 shows a double-stick strip of insulation 120 applied to the pane 114 in the area that the segment 116*d* had been removed previously. This spacing material is shown in FIG. 11 as being insulating, adhesive material, covered with removable sheets of material 122A and 122B.

The separated elements in FIG. 9 show how the frame 106 had been separated from the seal 116 in order to be able to allow a retaining metal strip 124 to be placed about a second window pane 126. The pane 126 is shown in FIG. 9 as having been pressed onto the surface of the adhesive strip of spacing material on the exposed adhesive.

When the window has been reassembled, as shown in FIG. 10, it can be seen that the strip 124, with its first edge 124*b* placed inside the frame 106, and its second edge 124*c* placed in a retaining position against the second pane 126, serves as a frame-like structure for the second pane. The offset portion 124*a* interconnects the two edges 124*b* and 124*c*. The offset is such that it can accomodate a particular thickness of glass that is being used as the second added pane.

FIG. 12 shows a conventional fixed window of the type that is usually associated along with a sliding window. The window 200 is shown as having a single pane of glass 202 held in a frame 204. Again, a seal 206 is shown as holding the pane 202 therein.

In FIG. 12 there is shown the manner in which a double-stick strip of insulating material 208 is affixed to the outside of the frame 204 immediately adjacent the edge by the glass. A second pane 210 is cut to the size that would fit over the adhesive strip as shown in FIGS. 15 & 16. A frame assembly of strips is shown at 210 and this assembly is composed of segments 212. The segments are shown in FIG. 18 as overlapping at the intermediate meeting points and in such a manner that water running off the side of the window would not seep into the window seal and glass areas. The portion 212*a* interconnects flat portions 212*b* and 212*c* which respectively contact the frame and glass that had been added. Holes 214 are then located about the frame on the flat segment 212*b* and fasteners are provided at 216 to secure the frame about the seal and second glass pane to the initial window frame.

The section indicated in FIG. 16 shows the assembled unit.

FIG. 17 is a view that illustrates that the penetration of the earlier described tip 52 of the gas supply 50 can be inserted through the seal member 120 into the compartment between the two panes of glass. The corners of the frame can be placed slightly apart, or an opening can be formed at that corner to allow the tip to be inserted through the seal.

FIG. 18 illustrates the fact that the strips for both the sliding window kit and the fixed window kit can be sold in lengths longer than are needed for most window sizes. Nevertheless, I have found that by trimming the sliding window strips to meet perfectly, and to overlap the fixed window strips has proven successful.

FIG. 19 shows an alternate embodiment of my invention wherein a triple-pane insulated window can be fabricated by my method. In this figure, the frame 300, retaining the initial glass pane 302 within seal member 304 is shown having a retaining strip of the nature shown to accomodate at least two additional panes.

The strip 306 is shown to have a connecting portion 306*a* which has a glass contacting portion 306*b* and a frame insertable extension 306*c*. In addition, I have provided an offset at 306*d* to further strengthen the strip and to better retain it within the window pane holding frame 300. Second and third panes 308 and 310 are retained and affixed by strips 312 and 314, respectively. The triple window can be easily used with a fixed window construction by merely following the various steps of the construction of FIG. 15. Fasteners would affix the strips to the fixed frame, and the extension 306*d* would simply be eliminated.

Occasionally, I have found that the topmost strip that retains the additional pane, or panes, has had to be narrower across the width that is closest to the outer main window frame at the point that the window would be lifted in order that it might be removed from its channel. This allows the operator to have enough clearance for proper reinsertion of the sliding window after it had been modified.

Although I have designated that the strips be of sheet metal, it is to be understood that other materials may be substitude, such as plastic, and the like. The spacing material is preferrably made of material which will resist weathering and will form an air tight seal between the panes of glass.

I have made reference to using an inert gas between the panes of glass to avoid accumulation of moisture. Also other things can be used, as I have mentioned, including dessicant material with a spacer.

Figure 21:
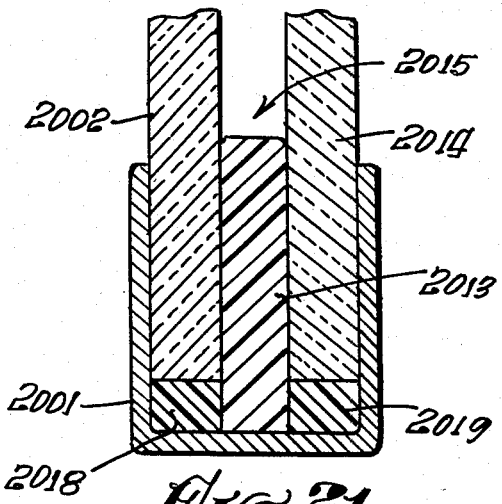
FIG. 21 shows a double-pane window formed in the same frame as shown in FIG. 20.

Additionally, a vacuum, or a partial vacuum, can be drawn between the two panes of glass by the use of a needle in the same manner as indicated for the insertion of inert gas, but with the needle attached to a source of a vacuum such as a vacuum pump or the like. This will be understood by those skilled in the art. Another way in which a partial vacuum can be created to eliminate moisture is to heat the glass and the area between the panes of glass quite substantially prior to placing the two panes of glass together with the spacing material between them. If this is done, when the glass cools there will be a partial vacuum within the area and this assists with the insulating quality of the double pane unit as well as aiding to reduce danger of condensation within the double-pane window. The embodiments which have previously been described are in my opinion, the preferrable embodiments of my method for converting a single pane window, utilizing the existing pane and frame. However, I have illustrated in FIGS. 20, 21, 22, 23 some alternatives which are interesting and should be mentioned as they could please certain persons more than the ones previously described. FIG. 20 illustrates in partial section a piece of a window frame 2001 of more or less standard construction having a pane of glass 2002 and vinyl or the like, as caulking 2003. FIG. 21 shows the result of a very simple conversion. The frame 2001 still exists, but the caulking material 2003 has been removed and a mastic material 2013 has been placed within the frame with a small space 2015 between the original pane of glass 2002 and a new pane of glass 2014. Space 2015 is small, but if a good vacuum is drawn it will provide rather satisfactory insulation.

Figure 22:
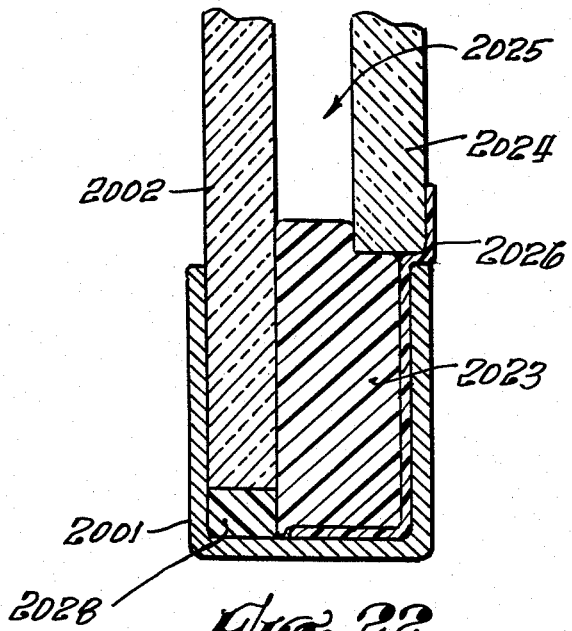
FIG. 22 illustrates an alternate method of forming the double-pane window within the existing frame.
Figure 23:
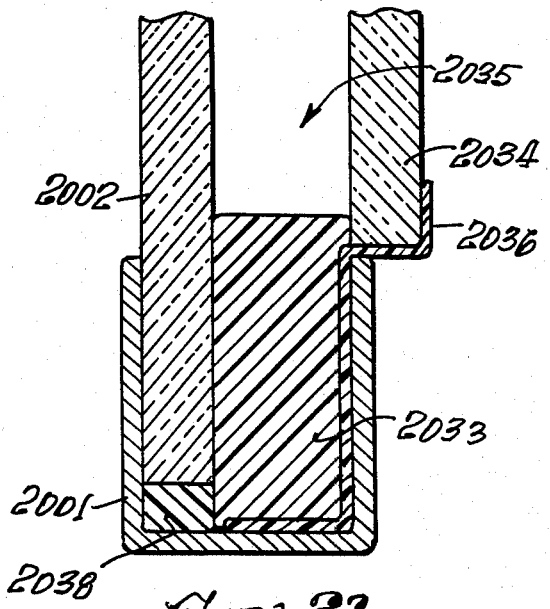
FIG. 23 is another alternate embodiment within the frame of FIG. 20.

FIG. 22 illustrates a means by which FIG. 21 can form a slightly larger space 2025 between the original piece of glass 2024. In this case, an adaptive element 2026 is utilized to extend nearly to the outer edge of the original frame 2001 so that the clearance will be identical to the original clearance. A mastic 2023 holds the pane of glass properly spaced and also assists in holding the adaptive element 2026 in place.

Lastly, with this simplified and modified method, but more closely approaching my original and previously described method, the pane of glass 2002 is moved over adjacent the edge of the frame 2001 as in the prior 2 illustrations, an adaptive element 2036 is utilized together with mastic 2033 and new pane of glass 2034 forming an enlarged space between the panes of glass 2035. The only advantage of this particular embodiment is to reach a compromise between my previously described method which are considered preferrable and a somewhat narrower finished unit to provide more clearance.

While not previously mentioned, my methods of conversion as illustrated in the foregoing description causes the absolute minimum loss of light through the converted window as compared to other methods of apparatus available and in addition provides an economical method.

It will be noted that I have referred to glass throughout the description, but the same method would apply where windows are formed of plastic material or the like rather than glass. Also, while I have described particularly windows, it is understood that this method applies to any glass covered opening in a building, such as a door or the like.

While the embodiments of this invention shown and described are fully capable of fulfilling the objects and advantages desired, it is to be understood such embodiments have been illustrated strictly for purposes of illustration and understanding, and not for the purpose of limitation.

I claim:

1. The method of converting an existing single-pane glass element within a frame in a building to a multi-pane glass element within the same frame comprising:

removing at least a portion of the caulking material along one side of the frame from the frame and the glass; loosening a portion of the frame about the existing pane of glass within the frame; providing spacer material about the perimeter of the existing glass within the frame; placing a new pane of glass cut to the appropriate size against the spacer material in such manner as to leave a space between the two panes of glass; and placing an adapter element inside the frame in such manner that it extends outwardly from the existing pane of glass and grips and holds the external edge of the new pane of glass.

2. The method of claim 1 wherein air is evacuated from the space between the two panes of glass.

3. The method of claim 1 wherein the adapter element is not used and the new pane of glass is placed within the existing frame.

4. The method of claim 1 wherein after the new pane of glass is placed upon the spacer material, another spacer material is placed around the new pane of glass and a third pane of glass is placed upon that spacer material so as to leave a space between the third pane of glass and the previous new pane of glass, and the adaptive element is so configured so as to hold the outer perimeter of the third piece of glass.

5. The method of claim 1 wherein the spacer material is adhesive to the glass wherever it touches the glass around the perimeter of the glass.

* * * * *